US009263791B2

(12) United States Patent
Anderson et al.

(10) Patent No.: US 9,263,791 B2
(45) Date of Patent: Feb. 16, 2016

(54) SCANNED ANTENNA HAVING SMALL VOLUME AND HIGH GAIN

(75) Inventors: Joseph M. Anderson, Tucson, AZ (US); Herbert A. Leach, Tucson, AZ (US); Charles G. Gilbert, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 592 days.

(21) Appl. No.: 13/543,989

(22) Filed: Jul. 9, 2012

(65) Prior Publication Data

US 2014/0009346 A1 Jan. 9, 2014

(51) Int. Cl.

| | |
|---|---|
| ***H01Q 15/02*** | (2006.01) |
| ***H01Q 1/24*** | (2006.01) |
| ***H01Q 1/28*** | (2006.01) |
| ***H01Q 19/06*** | (2006.01) |

(52) U.S. Cl.
CPC ..... *H01Q 1/246* (2013.01); *H01Q 1/281* (2013.01); *H01Q 19/065* (2013.01)

(58) Field of Classification Search
CPC ..... H01Q 1/281; H01Q 19/065
USPC ..... 343/909, 700 MS, 705, 793, 767
See application file for complete search history.

(56) References Cited

U.S. PATENT DOCUMENTS

| | | | | |
|---|---|---|---|---|
| 4,897,664 | A | 1/1990 | Killackey et al. | |
| 6,342,866 | B1 * | 1/2002 | Ho et al. | 343/795 |
| 6,552,696 | B1 * | 4/2003 | Sievenpiper et al. | 343/909 |
| 2009/0273527 | A1 * | 11/2009 | Behdad | 343/705 |
| 2010/0231479 | A1 * | 9/2010 | Hauhe et al. | 343/881 |
| 2011/0030757 | A1 * | 2/2011 | Lin et al. | 136/244 |

* cited by examiner

*Primary Examiner* — Dieu H Duong
(74) *Attorney, Agent, or Firm* — Daly, Crowley, Mofford & Durkee, LLP

(57) ABSTRACT

A scanned radio frequency (RF) antenna having a small volume is described.

26 Claims, 6 Drawing Sheets

SCANNED ANTENNA HAVING SMALL VOLUME AND HIGH GAIN

FIELD OF THE INVENTION

The system and techniques described herein relate generally to radio frequency (RF) antennas, more particularly, to scanned RF antennas.

BACKGROUND OF THE INVENTION

As is known in the art, there is a trend to increase the number of radio frequency (RF) antennas disposed on both commercial and military structures including both airborne and land-based structures and vehicles. Such structures and vehicles may be either stationary or mobile. For example, RF antennas are often disposed on cell towers, missiles, aircraft, and mobile ground based vehicles.

As is also known, there is an increasing trend to place even more RF antennas on such structures. Since there is often a limited amount of space in which to place the antennas, there is a concomittant increase in the value of the space occupied by each antenna. Accordingly, it is desirable to utilize RF antennas which occupy the least amount of space (i.e. occupy the least amount of volume and real estate on the structures) while still providing a desired level of performance. Utilizing compact RF antennas frees up valuable surface area and in structures on which the RF antennas are disposed.

In missile applications, for example, high gain fixed beam antennas (e.g. fuse antennas) typically occupy a relatively large volume in order to provide the antenna having desired gain and antenna pattern characteristics. It would, therefore, be desirable to provide compact antennas which occupy a relatively small volume compared with conventional antennas providing the same function. For example, it would be desirable to provide compact fuse antennas which occupy a relatively small volume compared with conventional fuse antennas having substantially the same desired gain and antenna pattern characteristics.

SUMMARY OF THE INVENTION

In accordance with the concepts, systems, circuits and techniques described herein, an antenna includes a single element radiator having a frequency selective surface (FSS) disposed over a first surface thereof and a Fresnel surface disposed over a second opposing surface of the single element radiator.

With this particular arrangement, a compact antenna having a volume which is relatively small compared with similarly functioning conventional antennas is provided. The combination of the single radiator and the FSS provides the antenna having a gain characteristic which is increased over antennas which occupy the same amount of space. Furthermore, the Fresnel surface acts as a reflecting surface which provides beam shaping and scanning. Making use of frequency selective surfaces and reflective ground planes provides the antenna having enhanced gain and scan characteristics while maintaining a relatively small volume. Furthermore, by utilizing a single element radiator and making use of an FSS, a highly efficient, compact radiating conformal antenna is provided.

Benefits of providing an antenna from a single radiator and a frequency selective surface (FSS) include, but are not limited to: simpler construction, reduced antenna volume which frees up volume on the structure on which the antenna is mounted, an enterprise wide solution (i.e. this antenna approach can be used in a wide variety of different applications); reduced costs (due to both ease of construction and commonality of design across a wide number of different applications). Furthermore, the antenna described herein is less complex than other antennas having similar gain and scanning characteristics which results in antennas having a reliability characteristic which is higher than the reliability characteristic of functionally similar antennas.

DETAILED DESCRIPTION OF THE PREFERRED EMBODIMENTS

Figure 1:
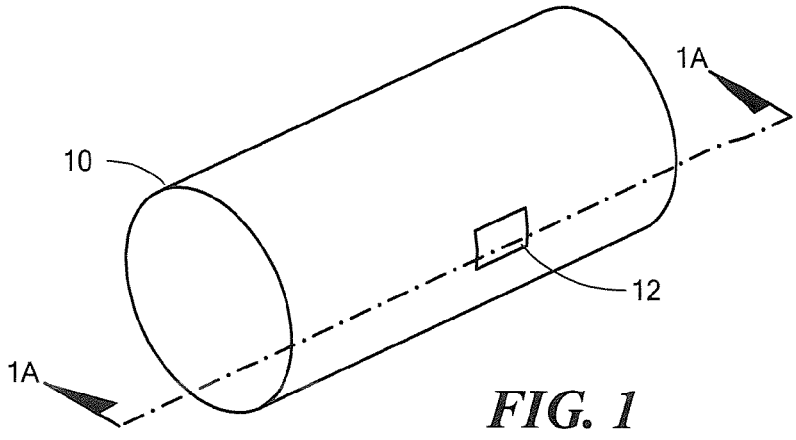
FIG. 1 is an isometric view of a portion of a structure having disposed thereon an antenna comprising a single element radiator, a frequency selective surface (FSS) and a Fresnel zone reflecting ground portion.
Figure 1A:
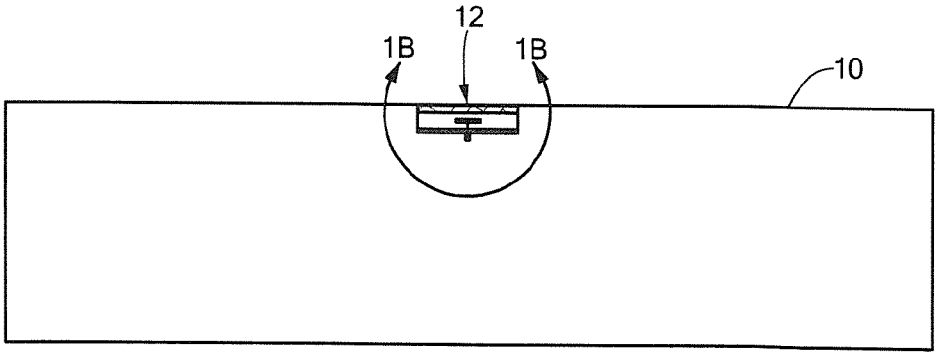
FIG. 1A is a cross-sectional view of FIG. 1 taken along lines 1A-1A in FIG. 1.
Figure 1B:
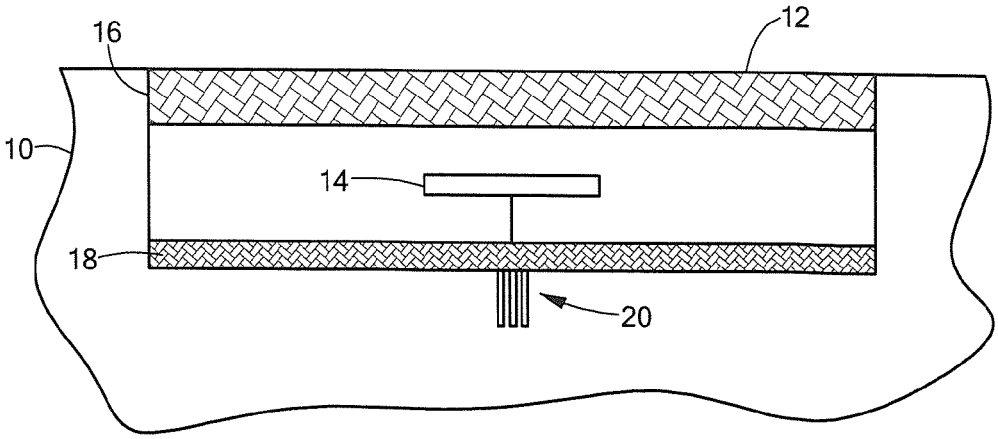
FIG. 1B is an enlarged view of a portion of FIG. 1A taken along lines 1B-1B in FIG. 1A.

Referring now to FIGS. 1-1B, in which like elements are provided having like reference numerals throughout the several views, a portion of a structure 10 has disposed thereon an antenna 12. Structure 10 may correspond to a portion of an airborne or land based structure which may be either a stationary structure or a mobile structure. For example structure 10 may be provided as a missile body, an aircraft, a cell tower, or a land based vehicle.

Antenna 12 includes a single element radiator 14 (FIG. 1B) having first and second opposing surfaces and a frequency selective surface (FSS) 16 disposed above the first surface of the single element radiator 14. In the exemplary embodiment of FIG. 1B, element 14 is provided as a center fed dipole antenna element. A feed 20 couples RF signals to/from antenna element 14. Feed 20 may be provided from a coaxial cable or other type of appropriate feed known to those of ordinary skill in the art. It should be appreciated that other types of antenna elements including but not limited to a variety of different types of printed circuit elements (e.g. patches), slot antenna elements, horn antenna elements and may, of course, also be used.

In on embodiment, FSS 16 is provided from a dielectric substrate having conductors patterned or otherwise provided on one or both surfaces thereof. The FSS can be designed in the conventional sense, however, a quarter wavelength thick dielectric substrate may also be used for the reflective surface.

Antenna 12 further includes a Fresnel zone reflecting surface 18 (also sometimes referred to herein as Fresnel reflector 18) disposed about the second surface of single element radiator 14. Fresnel reflector 18 provides antenna 12 having a beam steering function. The Fresnel reflector rings 18 are designed such that the rays of radiation coming from the FSS reflect off the Fresnel zones patterns resulting in collimation at a desired scan angle. In the exemplary embodiment of FIG. 1, antenna element 14 is provided having a length in the range of about one-half wavelength at a frequency of interest. Also in the exemplary embodiment of FIG. 1, the spacing between the radiator and FSS should be about one-half wavelength. It should be appreciated that the spacing between the radiator and FSS or Fresnel can have an impact on the antenna side-lobe structure If the FSS is composed of dipoles etched upon a typical circuit board the dipole will be about one-half wavelength (ignoring the dielectric constant effect onto which the FSS dipoles are disposed. The shape and geometry of the Fresnel pattern will be dependent upon the scan angles desired and freq of operation.

Single radiator 14 makes use of both FSS 16 top surface and Fresnel zone reflecting ground portion 18 for beam steering in order to achieve a high gain small aperture scanned radiation.

Figure 2:
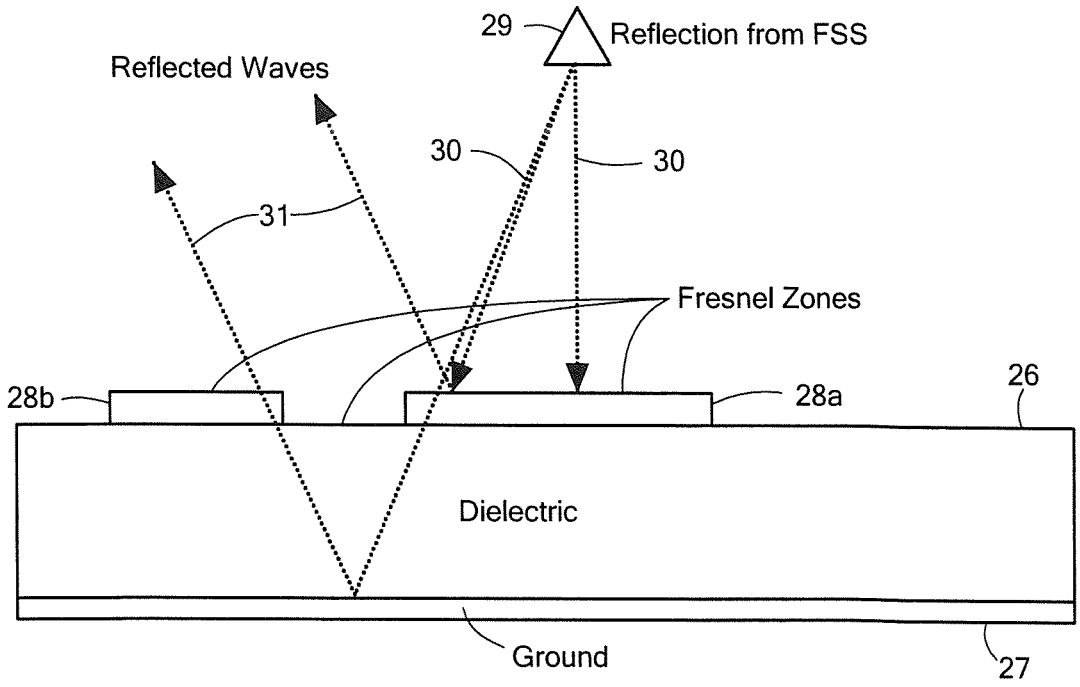
FIG. 2 is a cross-sectional view of an antenna comprising a single element radiator, a frequency selective surface (FSS) and a Fresnel zone reflecting ground portion.
Figure 2A:
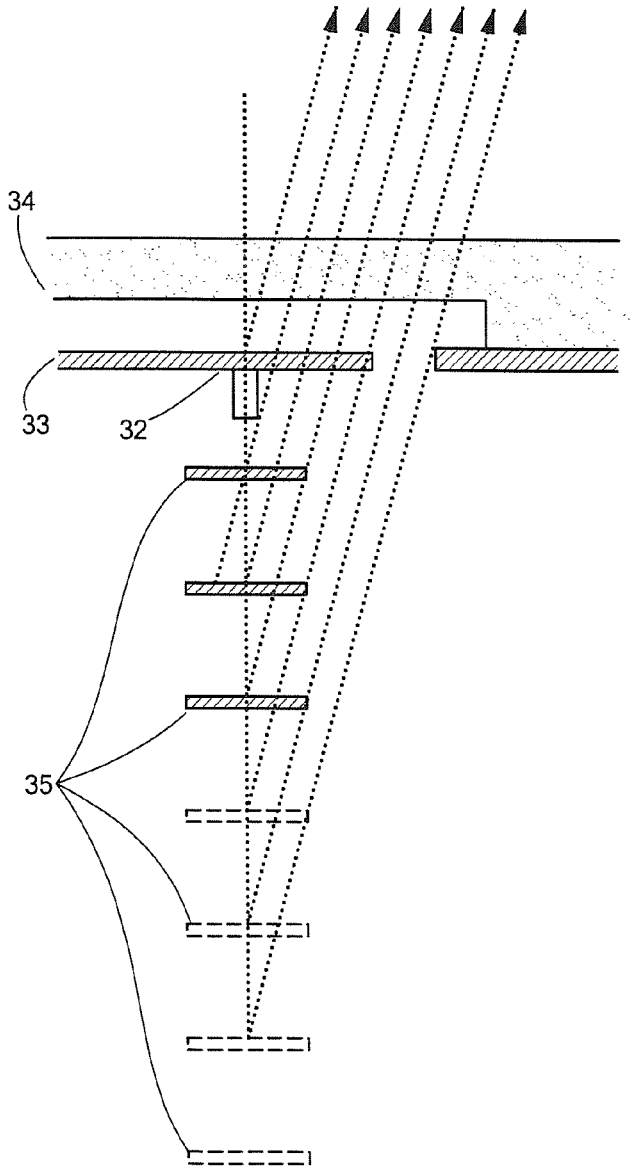
FIG. 2A is a schematic diagram which illustrates how scanning is achieved.

Referring now to FIGS. 2-2A, the antenna includes a dielectric substrate 26 having a conductive layer 27 disposed over a first surface thereof. Conductive layer 27 corresponds to a ground plane. Conductive elements, 28*a*, 28*b* are disposed over a second, opposing surface of substrate 26. A frequency selective surface 29 is disposed above conductors 28*a*, 28*b*. With this configuration, scanning is achieved as follows. Conductors 28*a*, 28*b* form Fresnel zones. Electromagnetic waves designated 30 reflected from FSS 29 are re-reflected off of conductors 28*a*, 28*b* and ground plane 27 to provide re-directed electromagnetic waves 31. It should be appreciated that electromagnetic waves 31 are at an angle (i.e. scanned) relative to a normal direction with respect to the ground plane.

Figure 2B:
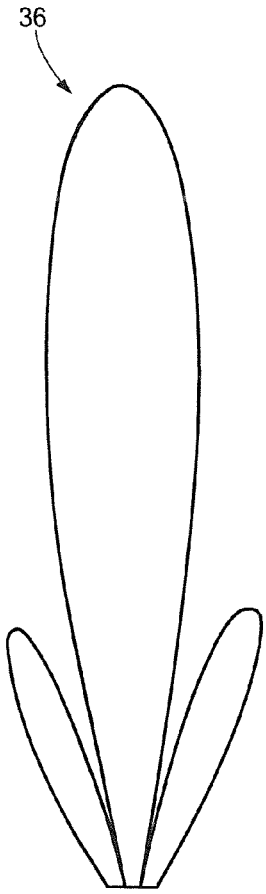
FIG. 2B is an exemplary radiation pattern.

As shown in FIG. 2A, electromagnetic waves are emitted from a radiator 32 embedded in a ground plane 33. A partially reflective surface 34 (or dielectric) is disposed above radiator 32 to reflect electromagnetic waves incident thereon. The reflected electromagnetic waves are re-reflected off of a ground plane 33 at an angle and thus appear to be generated by an array of image radiators 35. Referring now to FIG. 2B, an antenna operating with the concepts described above in conjunction with FIGS. 1-2A generates a highly directive broadside radian pattern 36 as shown in FIG. 2B.

Figure 3:
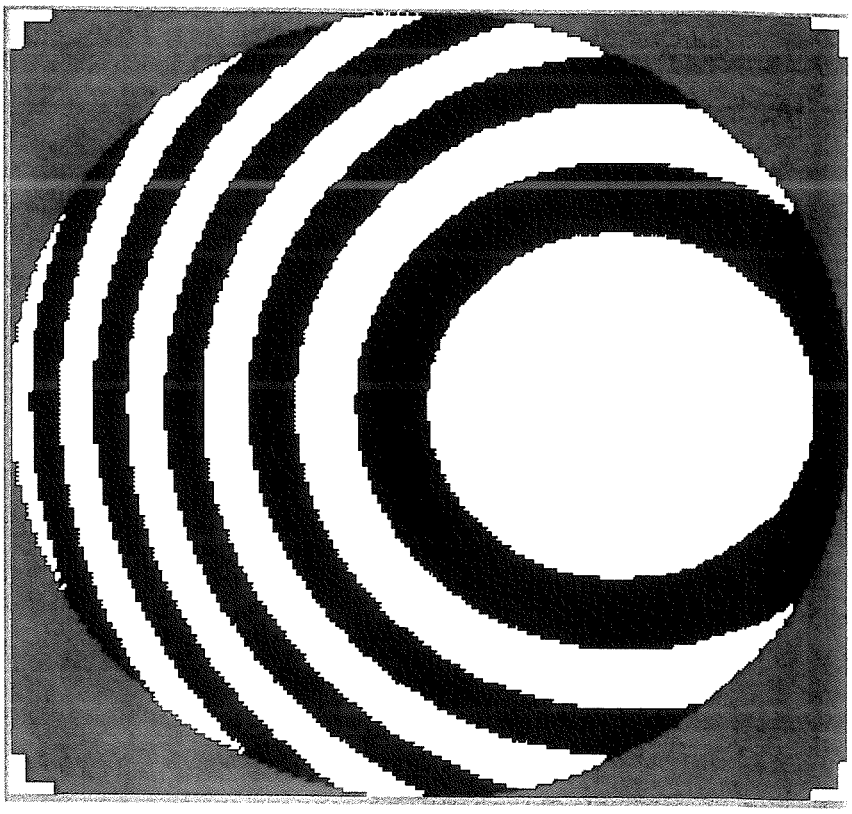
FIG. 3 is a Fresnel pattern on a reflecting ground surface.

Referring now to FIG. 3, an exemplary Fresnel pattern generated by a Fresnel reflector of the type appropriate for use in the exemplary antenna embodiments of FIGS. 1, 2, 4 and 5 described herein is shown. It should be appreciated that FIG. 3 represents a generic Fresnel pattern which would be etched onto a ground plane for a given antenna radiating source above the Fresnel surface.

Figure 4:
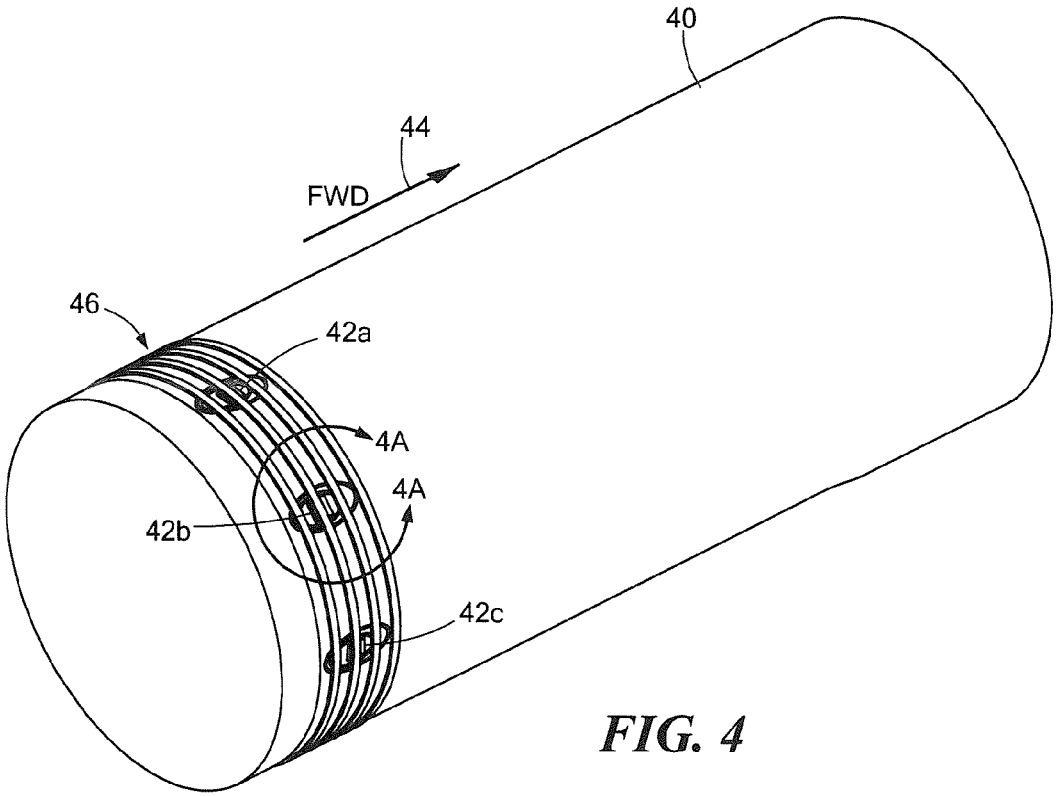
FIG. 4 is an isometric view of a portion of a structure having a plurality of conformal antenna elements disposed thereon with each of the antenna elements including a frequency selective surface (FSS) and a Fresnel ring.
Figure 4A:
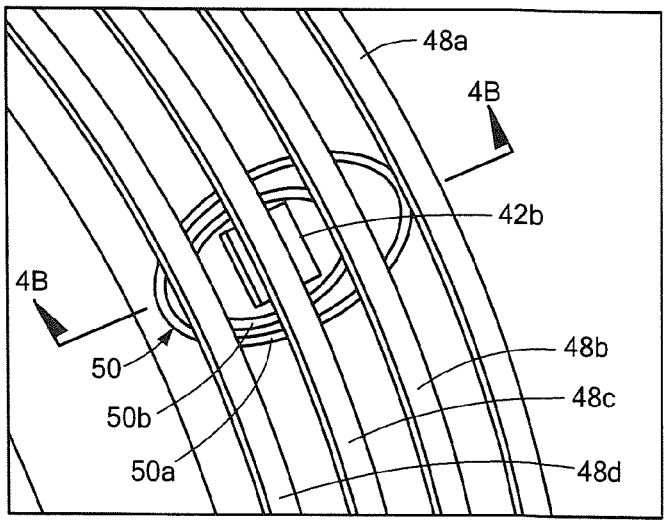
FIG. 4A is an enlarged view of a portion of FIG. 4 taken along lines 4A-4A in FIG. 4.

Referring now to FIGS. 4 and 4A in which like references designations are provided having like reference numerals, a portion of a body 40 has disposed thereon a plurality of conformal antenna elements 42*a*-42*c*. The body 40 may correspond, for example, to a fuselage such as a missile or aircraft fuselage. Body 12 is also intended to be representative of any structure (either airborne or land based or mobile or stationary) for use in any application in which a conformal antenna may be useful or desired.

Each antenna element 42*a*-42*c* produces a fan beam radiation pattern shape. That is, the main beam is pointed off angle from the forward direction (as designated by reference numeral 44), with partial pattern coverage in the circumferential direction. A frequency selective surface 46 is provided from a plurality, here four, conductive elements 48*a*-48*d*. It should be appreciated that the number of rings 48 are selected in accordance with the needs of a particular application. It should also be appreciated that the rings could also be provided as discrete length dipoles. The widths of the rings will determine the amount of reflectivity and therefore enhanced gain from that of a single radiator. It should also be appreciated that the rings (or bonds) need not be continuous. For example, the antenna would still operate as desired if the bands passed across the single antenna element and then stopped. For example, the bands or rings may be provided from a series or segments of conductors (e.g. as in a "dashed" or "dotted" line depending upon the length of each segment). It should be appreciated that since the FSS and Fresnel surface are in the near field of the antenna radiator, some coupling effects may occur and have to be addressed either through commercial three-dimensional modeling or solving the resultant boundary value problem analytically.

Disposed about each antenna element 42*a*-42*c* are a Fresnel surface provided by a plurality here two, Fresnel rings 50*a*, 50*b*. The number of bands or rings 50*a*, 50*b* are selected based, in part, upon the amount of gain enhancement desired and frequency bandwidth, the higher the gain enhancement the lower the frequency bandwidth of operation. It should be noted that bands 48 need not be continuous.

It should be appreciated that while the thickness of the FSS is not important, the thickness of the core material onto which the Fresnel pattern is etched should be about one-quarter wavelength. In one exemplary design, the single element radiator may be provided as one-half wavelength element, the spacing between the FSS and Fresnel patterns is also one-half wavelength. The FSS rings and spacing depends again upon the gain enhancement desired and BW trade.

Figure 5:
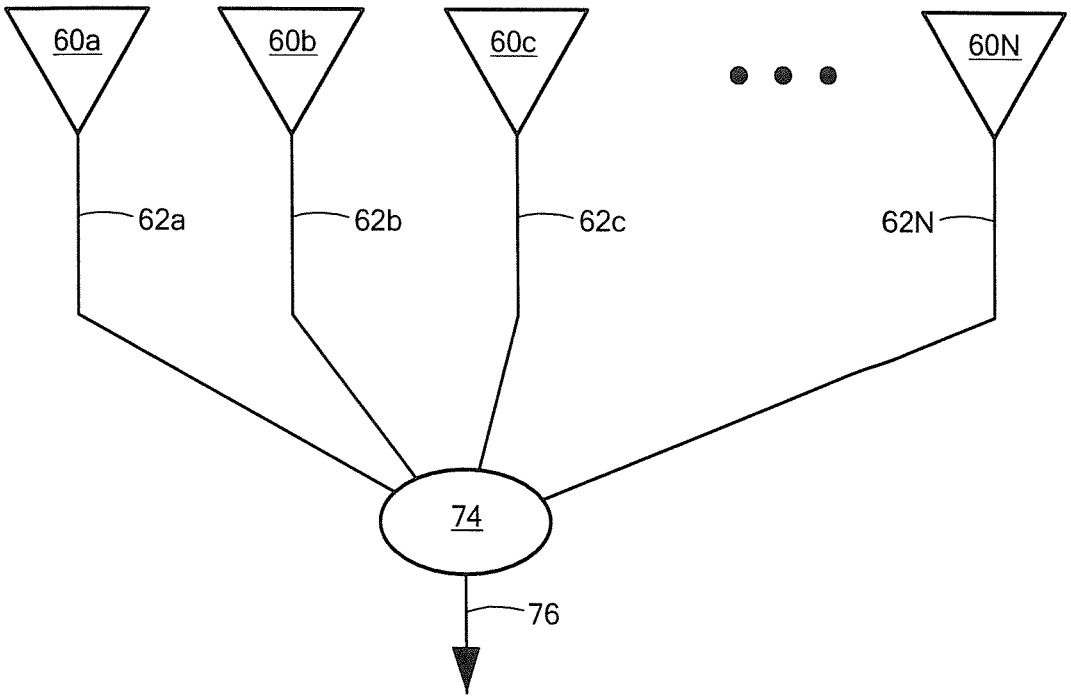
FIG. 5 is a schematic diagram of an example of combining antenna elements for a fuse antenna application.

Referring now to FIG. 5, signals from a plurality of antenna elements 60*a*-60N are provided through signal paths 62*a*-62N to a summing network 74. When antenna elements 60*a*-60N are disposed around a structure having a circular cross-sectional shape (e.g. structure 40 in FIG. 4) summing network 74 combines the signals provided thereto from the antenna elements to produce a continuous conical radiation pattern around a circumferential direction of a structure (such as body 40 shown in FIG. 4 above).

Having described preferred embodiments which serve to illustrate various concepts, structures and techniques which are the subject of this patent, it will now become apparent to those of ordinary skill in the art that other embodiments incorporating these concepts, structures and techniques may be used. Accordingly, it is submitted that that scope of the patent should not be limited to the described embodiments but rather should be limited only by the spirit and scope of the following claims.

What is claimed is:

1. A radio frequency (RF) antenna comprising:

a single element radiator having first and second opposing surfaces said single element radiator responsive to RF signals having a frequency of interest;

a frequency selective surface (FSS) disposed over the first surface of said single element radiator;

a Fresnel surface disposed over the second surface of said single element radiator; and wherein the Fresnel surface further comprises a ground plane disposed either as part of the Fresnel surface or below the second surface of said single element radiator and wherein a scan angle of the antenna is controlled by the FSS, a Fresnel pattern of conductors in the Fresnel surface and a Fresnel pattern in the ground plane; and the reflected waves are brought in phase by double reflection.

2. The antenna of claim 1 wherein the FSS comprises a conductor disposed on a surface above said single radiator element.

3. The antenna of claim 1 wherein the RF antenna is provided having a thickness in the range of about one wavelength at a frequency of interest and a length in the range of about one-quarter to about one-half wavelength at the frequency of interest.

4. The antenna of claim 1 wherein said single element radiator is provided as one of: a patch element, a dipole, a horn or a slot antenna element.

5. The antenna of claim 1 wherein said FSS is spaced from said single element radiator by about one-half wavelength.

6. The antenna of claim 1 wherein said Fresnel reflector surface is spaced from said single element radiator by about one-quarter wavelength.

7. The antenna of claim 1 wherein said single element radiator is provided as a printed circuit antenna disposed on a dielectric substrate.

8. The antenna of claim 1 wherein at least one of said FSS and said Fresnel surface are provided on a surface of a dielectric substrate.

9. A fuse antenna, for use on a missile, the fuse antenna comprising:

a single element radiator having first and second opposing surfaces;

a frequency selective surface (FSS) disposed over the first surface of said single element radiator;

a Fresnel zone reflecting surface disposed over the second surface of said single element radiator, said Fresnel zone reflecting surface configured to steer an antenna beam produced by said single element radiator in a predetermined direction which is different than a direction normal from said Fresnel zone reflecting surface; and wherein the Fresnel surface further comprises a ground plane disposed either as part of the Fresnel surface or below the second surface of said single element radiator and wherein a scan angle of the antenna is controlled by the FSS, a Fresnel pattern of conductors in the Fresnel surface and a Fresnel pattern in the ground plane; and the reflected waves are brought in phase by double reflection.

10. The fuse antenna of claim 9 wherein said frequency selective surface is disposed about the circumference of the missile.

11. The fuse antenna of claim 9 wherein said frequency selective surface is continuously disposed about the circumference of the missile.

12. The fuse antenna of claim 9 wherein said Fresnel zone reflecting surface is provided from a plurality of conductors.

13. The fuse antenna of claim 9 wherein said Fresnel zone reflecting surface comprises a plurality of conductors disposed in a ring pattern.

14. The fuse antenna of claim 9 further comprising an antenna feed circuit.

15. A high-gain antenna for transmitting or receiving electromagnetic radiation comprising:

a Fresnel zone reflecting surface for reflecting electromagnetic radiation;

a single element radiator positioned one-quarter of a wavelength above said Fresnel zone reflecting surface;

a frequency selective surface disposed one-half of said wavelength above said Fresnel zone reflecting surface and positioned parallel to said Fresnel zone reflecting surface; and wherein the Fresnel surface further comprises a ground plane disposed either as part of the Fresnel surface or below the second surface of said single element radiator and wherein a scan angle of the antenna is controlled by the FSS, a Fresnel pattern of conductors in the Fresnel surface and a Fresnel pattern in the ground plane; and the reflected waves are brought in phase by double reflection.

16. The antenna of claim 15 wherein said Fresnel zone reflecting surface comprises a substrate having a plurality of conducts disposed thereon in a ring pattern.

17. The antenna of claim 15 wherein said Fresnel zone reflecting surface comprises at least two rings.

18. The antenna of claim 15 wherein said frequency selective surface has a thickness corresponding to one-quarter of a wavelength of the electromagnetic radiation traveling through said frequency selective surface, said thickness being inversely proportional to the relative dielectric constant of said frequency selective surface.

19. The antenna of claim 15 wherein said single element radiator is provided as one of a one-quarter wave dipole; a one-half wave dipole; a patch; and a slot.

20. A high-gain antenna for transmitting or receiving electromagnetic radiation comprising:

a Fresnel surface comprising a plurality of Fresnel reflectors for reflecting electromagnetic radiation and a ground plane;

a plurality of single element radiators, each of said plurality of single element radiators disposed one-quarter of a wavelength above a corresponding one of said plurality of Fresnel reflectors; and a frequency selective surface (FSS) disposed one-half wavelength above said Fresnel reflectors and positioned parallel to said Fresnel reflectors wherein the ground plane of the Fresnel surface is disposed either as part of the Fresnel surface or below the plurality of single element radiators and wherein a scan angle of the antenna is controlled by the FSS, a Fresnel pattern of conductors in the Fresnel surface and a Fresnel pattern in the ground plane and the reflected waves are brought in phase by double reflection.

21. The antenna of claim 20 wherein each of said plurality of Fresnel reflectors comprises a plurality of conductors.

22. The antenna of claim 20 wherein each of said plurality of Fresnel reflectors comprises a plurality of conductors disposed on a dielectric substrate.

23. The antenna of claim 22 wherein each of said plurality of Fresnel conductors comprises a plurality of oval-shaped conductors disposed about said single element radiator.

24. The antenna of claim 22 wherein said dielectric substrate has a relative dielectric constant of at least 2.5.

25. The antenna of claim 20 wherein said frequency selective surface comprises a dielectric substrate having a thickness one-quarter of a wavelength of the electromagnetic radiation traveling through said substrate, said thickness being inversely proportional to the relative dielectric constant of said substrate.

26. The antenna of claim 25 where said frequency selective surface further comprises a plurality of conductors disposed on a surface of said substrate.

* * * * *